US009401101B2

(12) United States Patent
Jones

(10) Patent No.: US 9,401,101 B2
(45) Date of Patent: Jul. 26, 2016

(54) TAG AND ASSOCIATED SECURING MEANS AND METHOD

(75) Inventor: Grant Jones, Swansea (GB)

(73) Assignee: Fixxon Limited, Swansea (GB)

( * ) Notice: Subject to any disclaimer, the term of this patent is extended or adjusted under 35 U.S.C. 154(b) by 0 days.

(21) Appl. No.: 13/991,982

(22) PCT Filed: Dec. 5, 2011

(86) PCT No.: PCT/GB2011/052395

§ 371 (c)(1),
(2), (4) Date: Aug. 9, 2013

(87) PCT Pub. No.: WO2012/076867

PCT Pub. Date: Jun. 14, 2012

(65) Prior Publication Data

US 2013/0312301 A1 Nov. 28, 2013

(30) Foreign Application Priority Data

Dec. 6, 2010 (GB) ..... 1020641.5

(51) Int. Cl.

| | |
|---|---|
| ***A44C 5/00*** | (2006.01) |
| ***G09F 3/14*** | (2006.01) |
| *G09F 3/03* | (2006.01) |

(52) U.S. Cl.

CPC . *G09F 3/14* (2013.01); *G09F 3/037* (2013.01); *Y10T 24/1498* (2015.01); *Y10T 24/4691* (2015.01)

(58) Field of Classification Search

CPC ..... G09F 3/005; G09F 3/04; G09F 3/14
See application file for complete search history.

(56) References Cited

U.S. PATENT DOCUMENTS

| | | | | | |
|---|---|---|---|---|---|
| 1,814,290 | A | * | 7/1931 | Cartier | 24/708.2 |
| 2,104,755 | A | | 1/1938 | Masino | |
| 3,146,012 | A | * | 8/1964 | King, Sr. | 292/320 |
| 3,149,869 | A | * | 9/1964 | Chamberlin | 292/320 |
| 3,383,740 | A | * | 5/1968 | Fraleigh | 24/708.2 |
| 3,806,997 | A | * | 4/1974 | Niwa | 24/709.9 |
| 3,953,910 | A | * | 5/1976 | Farb | 24/13 |
| 4,106,802 | A | * | 8/1978 | Lozio | 292/320 |
| 4,417,656 | A | * | 11/1983 | Kato | 206/346 |
| 4,425,394 | A | * | 1/1984 | Jenkins | 428/136 |
| 4,456,123 | A | * | 6/1984 | Russell | 206/343 |
| 5,046,221 | A | * | 9/1991 | Walker | 24/66.2 |
| 5,355,563 | A | * | 10/1994 | Kanno | 24/708.1 |
| 5,515,584 | A | * | 5/1996 | Adell | 24/709.8 |
| 5,546,688 | A | * | 8/1996 | Merser | 40/663 |
| 5,553,706 | A | * | 9/1996 | Gold | 206/296 |
| 6,085,449 | A | * | 7/2000 | Tsui | 40/1.6 |
| 6,098,253 | A | * | 8/2000 | Nishida et al. | 24/429 |

(Continued)

FOREIGN PATENT DOCUMENTS

| | | | |
|---|---|---|---|
| CA | 1131908 | A1 | 9/1982 |
| EP | 0279178 | A1 | 8/1988 |

(Continued)

*Primary Examiner* — Shin Kim
(74) *Attorney, Agent, or Firm* — Winstead PC

(57) ABSTRACT

The invention provides a tag (10), such as an identity tag, comprising a body (12) having a first securing means (20) and a second securing means (30) provided distal to the first securing means (20), wherein the first securing means (20) comprises a slot (22*a*) for receipt of at least a portion of a security fastening therethrough. Also provided is a method of attachment of such a tag to a material.

3 Claims, 3 Drawing Sheets

(56) References Cited

U.S. PATENT DOCUMENTS

| | | | | |
|---|---|---|---|---|
| 6,735,895 | B2 * | 5/2004 | Wada et al. | 40/664 |
| 6,915,602 | B2 * | 7/2005 | Davis et al. | 40/299.01 |
| 6,945,601 | B1 * | 9/2005 | Wu | 297/284.4 |
| 7,424,770 | B2 * | 9/2008 | Lyon | 24/711.1 |
| 8,151,502 | B2 * | 4/2012 | Waltersdorf | 40/633 |
| 8,347,537 | B2 * | 1/2013 | Huang | 40/633 |
| 2005/0139630 | A1 * | 6/2005 | Tamura et al. | 227/67 |
| 2009/0056177 | A1 * | 3/2009 | Mallozzi et al. | 40/1.6 |
| 2013/0074291 | A1 * | 3/2013 | Ozzard | 24/304 |

FOREIGN PATENT DOCUMENTS

| | | | |
|---|---|---|---|
| FR | 946346 | A | 5/1949 |
| GB | 116586 | A | 6/1918 |
| GB | 2327411 | A | 1/1999 |
| JP | 5-4915 | U | 1/1993 |
| JP | 10116033 | A | 6/1998 |
| JP | 3104833 | U | 10/2004 |
| WO | WO-2009/073892 | A1 | 6/2009 |

* cited by examiner

TAG AND ASSOCIATED SECURING MEANS AND METHOD

The present invention relates to a tag and associated securing means. In particular, the present invention relates to a tag and associated securing means with a method of securing which enables tags to be secured easily and comfortably to items of clothing.

It is common for people to use tags such as identification tags when their clothing or belonging, such as footwear, bags or accessories are going to be used in a communal environment. Children at school participating in sport or physical education, living at boarding school, or taking part in residential activities all typically require their clothing to be labelled to ensure that they return home with the clothes which are theirs. For people taking part in group or team activities requiring a common uniform, identification tags on the items, such as clothing or footwear, ensures that each person can easily identify their own clothing to wear on each outing, even if the clothing is all laundered or stored together. This is also the case for boots or other footwear or accessories in such group settings. In addition, those living in environments such as care homes or institutions, whilst having and wearing their own clothes, typically have their clothes laundered communally as part of the service provided by the institution. This ensures that each person's items of laundry can easily be identified and returned to them after laundering.

There are a variety of types of tags, including identification tags, currently available to use which can be secured to items in a range of different ways. Fabric identification tags, on which the name or details of the owner is embroidered or printed, have long been available. These fabric tags traditionally were designed to be sewn into the garment and to remove the label, the sewing is unpicked. However, secure sewing of a label is a skilled and time consuming process. As hand craft skills have become less commonplace and modern life has become more hectic, the process of sewing a label into multiple items of clothing has become less practical.

To overcome the cumbersome process of sewing from the application of labels, identification labels have been supplied with fabric adhesive which can be applied to the label before securing it to the item to be identified. Alternatively, the labels can be secured using an iron-on bonding material which secures the label to the item to be identified when pressed onto the item with an iron. These securing techniques are more simple and quick than sewing the label on. However, the adhesive or bonding used for these securing techniques are typically less durable than sewing and often, when exposed to repeated laundering, the bonding material or adhesive fails causing the label to detach from the item can causing confusion as to the ownership of the item which has lost its label.

More recently, mechanically secured identification tags have become available. An example of such tags is two-part, screw together tag. One part of the tag has the owners name etched onto one surface and is provided with a screw projection provided with a thread. The other part of the tag is a backing piece provided with a threaded hole which corresponds to the screw projection. These parts are placed on opposing sides of a part of fabric of the item and, using a mechanical attachment device, the screw is driven through the fabric and into the backing piece to secure the tag to the item. This mechanically attached tag is firmly secured to the item, by having a backing piece to which the screw projection is inserted. However, when secured to an item of clothing, there will always be a bulky part of the identification tag projecting towards the owner when the item of clothing is worn. This relatively bulky projection can, particularly for the elderly, cause discomfort and irritation when located next to the skin of wearer during wearing of a garment to which the tag is attached.

As an alternative to the use of identification tags, indelible ink pens are also currently marketed for use in writing the name of the item owner onto the item. However, whilst these are simple and quick to use, after several washes the ink normally starts to fade and eventually becomes too faint to read, making it difficult to identify who the item belongs to.

It is therefore an objective of the present invention to address at least one of the problems of the prior art.

A first aspect of the present invention provides a tag, such as an identity tag, comprising a body having a first securing means and a second securing means provided distal to the first securing means, wherein the first securing means comprises a slot for receipt of at least a portion of a security fastening therethrough.

Provision of a tag with securing means facilitates attaching the tag securely to a chosen item with the provision of a slot enabling at least a portion of the security fastening being operable to slot into position to secure the tag in the desired location.

Preferably, the second securing means is a slot. The provision of one or more slot securing means enables the tag to be releasably secured to an item.

Alternatively, the second securing means may be an integral security fastening. A tag having an integral security fastening and a slot securing means results in the tag having a self-contained securing mechanism which can be secured to items without the addition of any further components.

Preferably, the or each slot extends from one edge of the body towards the opposing securing means. Further preferably, the or each slot includes a recess within which a portion of the secure fastening is received in use. The provision of a recess within which a potion of the secure fastening is received in use means that the secure fastening can be securely releasably received in the slot.

The security fastening may comprise a flexible elongate member with a substantially T-shaped abutment at one end. The provision of a T-shaped abutment facilitates the fastening co-operating with the slot such that the fastening can be securely releasably retained resulting in the prevention of unintentional release of the fastening from the slot when in use.

Preferably, when the second securing means is an integral security fastening, the abutment is located distal to the body. The provision of the integral security fastening having the abutment located distally to the body enables the security means to be looped back on the body to co-operate with the first securing means slot such that in use the tag can be releasably secured to an item.

The second securing means may be an aperture extending from a first surface of the body to a second surface of the body defining a void therethrough.

Preferably, the aperture is operable to receive a security fastening means having an elongate member with a first abutment provided at one end and a second abutment provided at a second end.

The provision of securing means which is an aperture enables a security fastening means, which is not integral with the tag, to be arranged such that the elongate member extends through the aperture and a second abutment abuts against a first surface of the body thus retaining the security fastening in co-operation with the body to facilitate the attachment of the tag to an item as detailed above.

According to a second aspect of the invention there is provided a method of attachment of a tag such as an identity tag, to a material having a first substantially planar surface and a second opposing planar surface, the method comprising the steps of:

a. providing a tag in accordance with a first aspect of the invention;
b. providing a secure fastening comprising a flexible elongate member with a first and second abutment at the first and second ends respectively;
c. engaging the secure fastening with the second securing means;
d. passing the first abutment through the material from the first surface to the second surface and back again; and
e. engaging the securing fastening with the first securing means.

The method of attachment of the tag to a material ensures the tag is attached securely to the material whilst only a portion of the elongate member is present at the second surface of the material therefore reducing the potential for irritation whilst the tag is in used.

Preferably, step d. of the method further comprises the first abutment passing through the material from the first surface to the second surface and back again a plurality of times. By passing the first abutment through the material a plurality of times, in use, the elongate member exposed on the second surface of the material will be minimized whilst still ensuring the tag is firmly secured to the material.

The method may further comprise the step, between step c and step d, of folding the material. Folding the material will facilitate the passing the fastening through the material which can then be unfolded for use.

A third aspect of the present invention provides a method of attachment of a tag, such as an identity tag, to a material having a first substantially planar surface and a second opposing planar surface, the method comprising the steps of:

a. providing a tag in accordance with a first aspect of the invention in which the second securing means is an integral security fastening and wherein the integral secure fastening comprises a flexible elongate member provided with a first abutment at a first end distal to the body;
b. passing the first abutment through the material from the first surface to the second surface and back again; and
d. engaging the securing fastening with the first securing means.

The method of attachment of the tag to a material requires only one component to be attached securely to the material whilst only a portion of the elongate member is present at the second surface of the material therefore reducing the potential for irritation whilst the tag is in used.

Preferably, step b. of the method further comprises the first abutment passing through the material from the first surface to the second surface and back again a plurality of times. By passing the first abutment through the material a plurality of times, in use, the elongate member exposed on the second surface of the material will be minimized whilst still ensuring the tag is firmly secured to the material.

The method may further comprise the step, between step a. and step b., of folding the material. Folding the material will facilitate the passing the fastening through the material which can then be unfolded for use.

It will be understood that throughout the description the term tag is used to refer to any tag item which can carry information for display such as, but not limited to, a name or address, information such as advertising or branding, or personalized information such as a drawing or text, and is intended to include identity tags, identity buttons and the like.

Embodiments of the invention will now be described, by way of example only, and with reference to the accompanying drawings, in which.

Figure 1A:
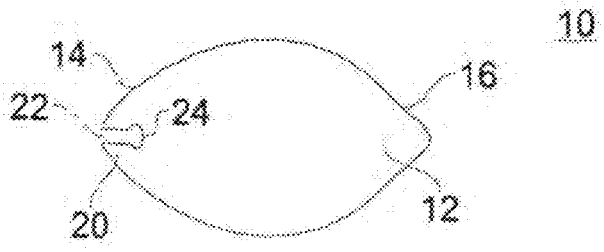
FIG. 1A shows a plan view of an identification tag according to a first embodiment of the present invention.
Figure 1B:
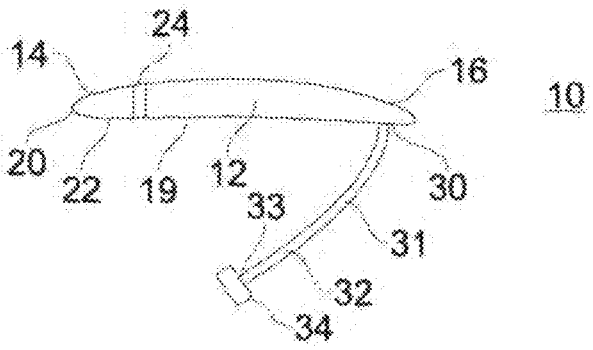
FIG. 1B shows a cross section view of an identification tag of FIG. 1B.

In FIGS. 1A and 1B is shown a first embodiment of an identity (ID) tag 10 comprising a body 12 having a first end 14 and a second end 16 arranged distal to the first end 14, an upper surface 18 and a lower surface 19. At first end 14, there is provided a first securing means 20 which in this case is a slot 22 which terminates in a recess 24. At second end 16 there is provided a second securing means 30, which in this case is an integral security fastening, comprising a flexible elongate member 32 which projects from the lower surface 19 at the second end 16 of the body 12. A T-shaped abutment 34 is provided at the end 36 of the elongate member 32 distal to the body 12. The slot 22 of the first securing means 20 can be seen to project into the body 12 towards second securing means 30 and slot 22 is operable to receive at least a portion the elongate member 32 of the security fastening 30 which is then retained in recess 24.

During use, second security means 30 can be looped back towards the body 12 such that abutment 34 co-operates with the first securing means slot 22 and recess 24. As a result, the inherent forces acting upon the retained second securing means 30 are directed back towards the second securing means 30 and thus the abutment 34 is biased against the upper surface 18 at first securing means 20. In addition, the retention of the security fastening 30 in recess 24 accessed by slot 22 means the security fastening 30 can be securely releasably received and retained in recess 24 resulting in the prevention of unintentional release of the fastening 30 from the slot 22 when in use and, should it be necessary, to also enable subsequent controlled removal of the tag 10 from the item (not shown). The integral security fastening 30 and slot securing means 20 results in the tag 10 having a self-contained securing mechanism which can be secured to items without the addition of any further security mechanism components.

Figure 2:
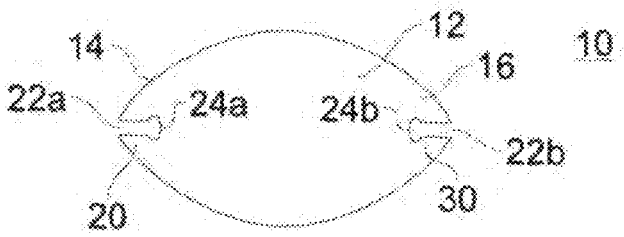
FIG. 2 shows a plan view of an identification tag according to a second embodiment of the present invention.

With reference to FIG. 2, there is shown a second embodiment of ID tag 10 comprising a body 12 having a first end 14 and a second end 16 arranged distal to the first end 14. At first end 14, there is provided a first securing means 20 which in this case is a slot 22*a* which terminates in a recess 24*a*. At second end 16 there is provided a second securing means 30 which in this case is a slot 22*b* which terminates in a recess 24*b*. As can be seen, each slot 22*a*, 22*b* extends from the respective end 14, 16 of the body towards the opposing securing means 30, 20. In use, each recess 24*a*, 24*b* receives a portion of a secure fastening (such as the security fastening 40 shown with reference to FIG. 4). As recesses 24*a* and 24*b* receives a security fastening during use, the security fastening can be securely and releasably received in the slots 22*a*, 22*b* which means the ID tag 10 can be securely releasably attached to an item (not shown).

Figure 3:
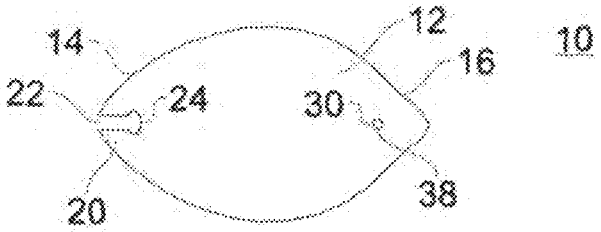
FIG. 3 shows a plan view of an identification tag according to a third embodiment of the present invention.

With reference to FIG. 3 there is shown a third embodiment of an ID tag 10 comprising a body 12 having a first end 14 and a second end 16 arranged distal to the first end 14. At first end 14, there is provided a first securing means 20 which in this case is a slot 22*a* which terminates in a recess 24*a*. At second end 16 there is provided a second securing means 30 which in this case is an aperture 38. In use, the aperture 38 is operable to receive a portion of a security fastening (such as the security fastening 40 shown with reference to FIG. 4) and recess 24 is operable to receive a further portion of such a secure fastening. By aperture 38 and recess 24 receiving a security fastening during use, the security fastening can be securely and releasably received in the slots 22 which means the ID tag 10 can be securely releasably attached to an item (not shown).

Figure 4:
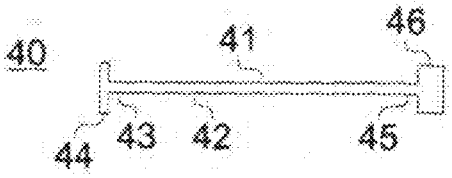
FIG. 4 shows a plan view of a security fastening for use with an identification tag of FIG. 2 or FIG. 3.

With reference to FIG. 4, there is shown a security fastening 40 which comprises a flexible elongate member 42 provided with a first substantially T-shaped abutment 44 at a first end 43, and a second substantially T-shaped abutment 46 at a second end 45. A central portion 41 of the elongate member 42 is located between the first end 43 and the second end 45 of the elongate member 42.

Figure 5:
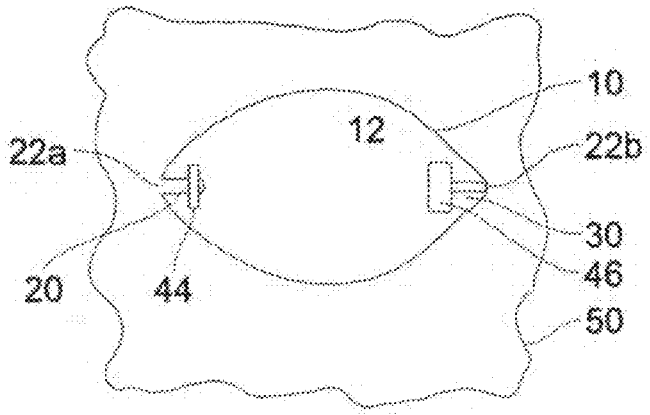
FIG. 5 shows a plan view of the identification tag of FIG. 2 attached to an item.
Figure 6:
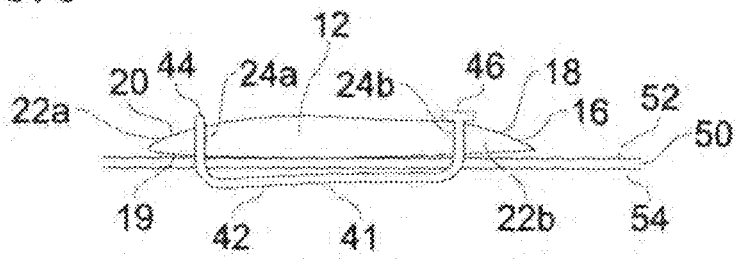
FIG. 6 shows a cross section view of the identification tag of FIG. 2 attached to an item.

In FIGS. 5 and 6, there is a shown an embodiment of an identification tag 10, such as that shown in FIG. 2, secured to a piece of material 50 using a security fastening 40. The material 50 is provided with a first surface 52 which is substantially planar and lies substantially in parallel with second surface 54 which is also substantially planar. As can be seen, ID tag 10 is provided with an upper surface 18 and a lower surface 19. Lower surface 19 is located against first surface 52 of material 50, to which the tag 10 is to be secured. Abutment 46 of fastening 40 is adjacent upper surface 18 of tag 10 with the second end 45 of the elongate member 42 of fastening 40 being received by recess 24*b* of second securing means 30. The elongate member 42 then extends beyond the lower surface 19 of the tag 10 and projects through material 50 and lies along the second surface 54 of material 50 such that it is in parallel with the lower surface 19 of the tag 10. The first end 43 of the elongate member 42 then projects back through material 50 and is received by recess 24*a* of first securing means 20 such that abutment 44 is adjacent to and biased against upper surface 18 of tag 10.

It will be clearly understood that the elongate member 42 is under tension as abutments 44 and 46 act against surface 18 and thus the tag 10 is securely held against the material 50 with only a central portion 41 of elongate member 42 being exposed on the second surface 54 of material 50. As only a central portion 41 of elongate member 42 is exposed on the second surface 54, and this central portion 41 will be under tension and so biased towards the material 50 and the tag 10. Thus, in use, the second surface 54 of the fabric can be positioned towards, for example, the wearer of a clothing item to which the tag 10 is attached. Thus, central portion 41 will be particularly unobtrusive and is unlike to cause irritation or discomfort to the use.

Figure 7:
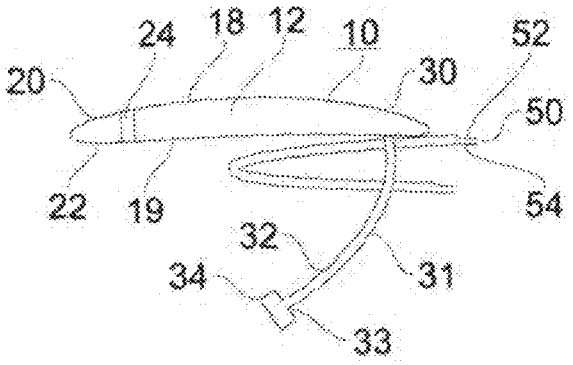
FIG. 7 shows a cross section of a tag of FIG. 1A during attachment to an item according to a fourth embodiment of the present invention.
Figure 8:
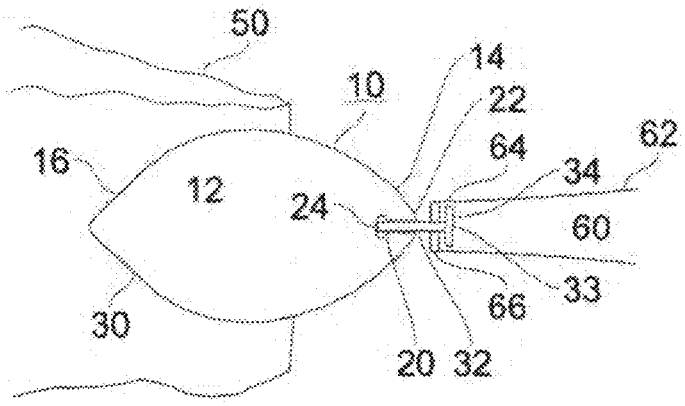
FIG. 8 shows a plan view of FIG. 7.

In FIGS. 7 and 8 there is shown a tag 10, which in this case is a tag 10 such as is shown in FIGS. 1A and 1B, being attached to an item which in this case is a material 50 having a first surface 52 and a second surface 54, using an integral security fastening 30. As can be seen, the material 50 is folded with the first surface 52 to the outside of the fold. The tag 10 is arranged such that first end 14 extends beyond the folded material 50 and the lower surface 19 at the second end 16 lies over a portion of the surface 52 of material 50. The flexible elongate member 32 of integral security fastening 30 projects from the lower surface 19 at second end 16 and extends through the first surface 52 and second surface 54 of material 50 before projecting through second surface 54 and first surface 52 of the fold of material 50.

In this case, to engage the abutment 34 with the slot 22 and recess 24 of the first securing means 20, a tool 60 is used. The tool 60 is provided at a first end 62 with a holding means 64. This tool 60 will be described in greater detail with reference to FIGS. 9A and 9B. The abutment 34 is collected in holding means 64 and tension is applied to the fastening means 30 to align the first end 33 of the elongate member 42 with slot 22. The holding means 64 is then used to direct the first end 33 of elongate member 32 to be slid in to slot 22 such that it is received by recess 24 with abutment 34 abutting against, and being biased towards, upper surface 18 of tag 10. The tag 10 will then be securely fastened to the material 50. Material 50 can subsequently be unfolded so that it lies in parallel with the surface 19 of tag 10 with only a central portion 31 of elongate member 32 being exposed on the second surface 54 of material 50. The integral security fastening 30 and slot securing means 20 results in the tag 10 having a self-contained securing mechanism which can be secured to items without the requirement of any further securing components.

In addition, the retention of the security fastening 30 in recess 24 accessed by slot 22 means the security fastening 30 can be securely releasably received and retained in recess 24 resulting in the prevention of unintentional release of the fastening 30 from the slot 22 when in use and, should it be necessary, to also enable subsequent controlled removal of the tag 10 from the item (not shown). The release of the tag 10 may be carried out by applying pressure on the abutment 34 which directs the abutment 34 towards the opening of the slot 22 at the first end 14 of the tag 10. The abutment may be pushed using any suitable mechanism including, but not limited to fingers or a solid object such as a screwdriver. Alternatively the holding mechanism 64 of tool 60 could be used to pull the abutment 34 towards the first end 14 of the tag 10. As the elongate member 32 is under tension this will require a degree of effort, however, once the abutment 34 is released from slot 22 the elongate member 32 and abutment 34 can be gently eased back through the material 50 to release the tag 10.

Figure 9A:
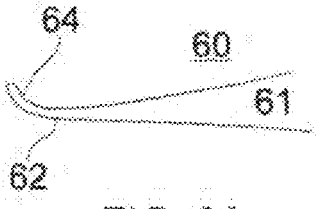
FIG. 9A shows a detail of a cross section a device for facilitating attachment of a tag of the present invention to an item.
Figure 9B:
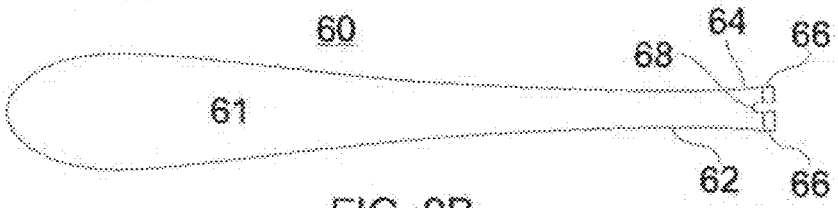
FIG. 9B shows a plan view of the device of FIG. 9A.

In FIGS. 9A and 9B, tool 60 is shown in more detail. As can be seen, the first end 62 of the tool is provided with a holding mechanism 64 which is curved so as to project substantially perpendicularly from the elongate handle 61 of the tool 60. The holding mechanism 64 further comprises projections 66 between which is defined a holding recess 68. As can be seen in FIG. 8, in use, the elongate member 32 lies in the holding recess 68 of the holding mechanism whilst abutment 34 is held within the curve of holding mechanism by projections 66 such that tension can be applied to the elongate member 32 enabling it to be directed towards slot 22 for securing.

Figure 10:
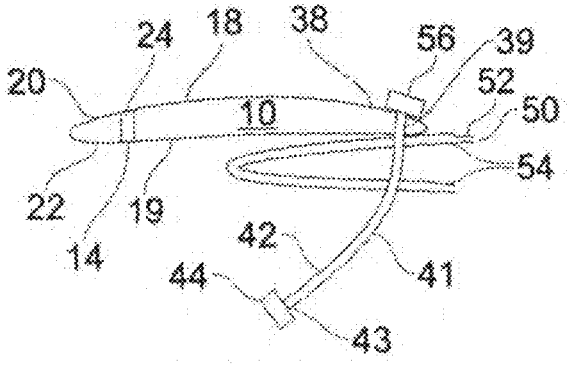
FIG. 10 shows a cross section of a tag of FIG. 3 during attachment to an item according to a fifth embodiment of the present invention.
Figure 11:
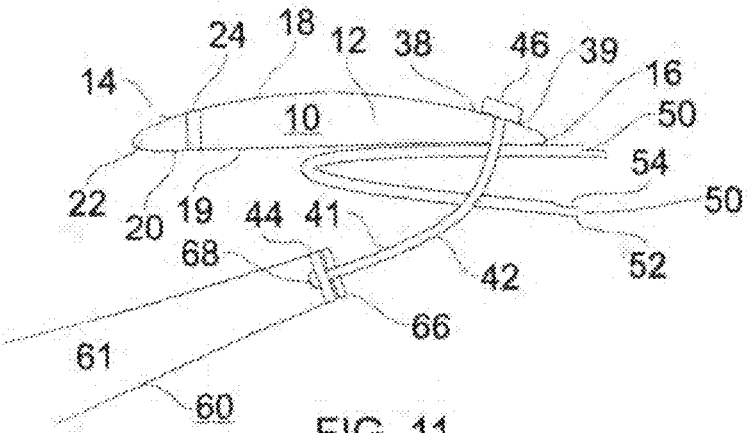
FIG. 11 shows a cross section of a tag of FIG. 3 during attachment to an item using the device of FIG. 9B according to a sixth embodiment of the present invention.
Figure 12:
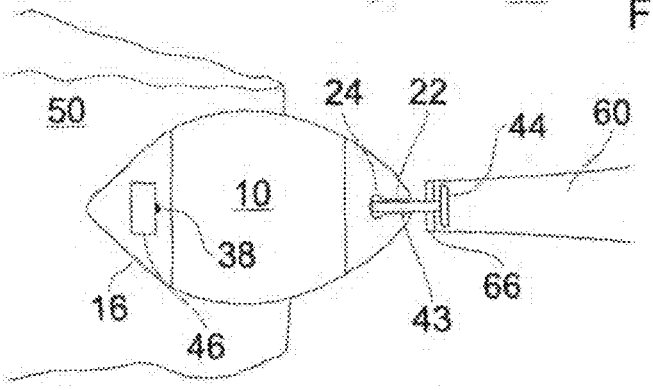
FIG. 12 shows a plan view of a tag of FIG. 3 during attachment to an item using the device of FIG. 9B according to an seventh embodiment of the present invention.

FIGS. 10, 11 and 12 show further embodiments of a tag 10, which in this case is a tag 10 such as is shown in FIG. 3, being attached to an item which in this case is a material 50 having a first surface 52 and a second surface 54, using a security fastening 40 such as that shown in FIG. 4. The tag 10 is provided a body 12 having a first end 14 and a second end 16 arranged distal to the first end 14. At first end 14, there is provided a first securing means 20 which in this case is a slot 22 which terminates in a recess 24. At second end 16 there is provided a second securing means 30 which in this case is an aperture 38 which extends between upper surface 18 and lower surface 19 and defines a void 39 therethrough. As can be seen, to attached the tag 10 to material 50, the material 50 is folded with the first surface 52 to the outside of the fold. The tag 10 is arranged such that first end 14 extends beyond the folded material 50 and the lower surface 19 at the second end 16 lies over a portion of the surface 52 of material 50.

In attaching the tag 10 to the material 50, the first abutment 44 and first end 43 of flexible elongate member 32 of security fastening 40 is passed through aperture 38. The second abutment 46 abuts against upper surface 18 of the tag 10 with second end 45 of the elongate member lying within the void 39. The first abutment 44 and first end 43 of flexible elongate member 32 project through the aperture 38 from the lower surface 19 at second end 16 and extends through the first surface 52 and second surface 54 of material 50 before projecting through second surface 54 and first surface 52 of the fold of material 50.

In this case, to engage the first abutment 44 with the slot 22 and recess 24 of the first securing means 20, a tool 60 is used. The abutment 44 is collected in holding means 64 such that projections 66 retain the abutment 44 in the curve whilst the first end 43 of elongate member 42 projects through holding recess 64. Using the tool 60, tension is applied to the fastening means 40, by acting against the co-operation between the surface 18 and second abutment 46 resulting in pressure on and thus tension in elongate member 43. Using the tool 60, the first end 43 of the tensioned elongate member 42 is aligned with slot 22. The holding means 64 is then used to direct the first end 43 of elongate member 42 to be slid in to slot 22 such that it is received by recess 24 with abutment 44 abutting against, and being biased towards, upper surface 18 of tag 10. The tag 10 will then be securely fastened to the material 50. Material 50 can subsequently be unfolded so that it lies in parallel with the surface 19 of tag 10 with only a central portion 41 of elongate member 42 being exposed on the second surface 54 of material 50.

The retention of the security fastening 40 in recess 24 accessed by slot 22 means the security fastening 40 can be securely releasably received and retained in recess 24 resulting in the prevention of unintentional release of the fastening 40 from the slot 22 when in use and, should it be necessary, to also enable subsequent controlled removal of the tag 10 from the item (not shown). The release of the tag 10 may be carried out by applying pressure on the abutment 44 which directs the abutment 44 towards the opening of the slot 22 at the first end 14 of the tag 10. The abutment 44 may be pushed using any suitable mechanism including, but not limited to fingers or a solid object such as a screwdriver. Alternatively the holding mechanism 64 of tool 60 could be used to pull the abutment 44 towards the first end 14 of the tag 10. As the elongate member 42 is under tension this will require a degree of effort, however, once the abutment 44 is released from slot 22 the elongate member 42 and abutment 44 can be gently eased back through the material 50 to release the tag 10.

Using this method of attachment to attach the tag 10 to a material 50 ensures the tag 10 is attached securely to the material 50 whilst only the central portion 41 of the elongate member 42 is exposed at the second surface 54 of the material 50 therefore reducing the potential for irritation to a wearer whilst the tag 10 is in use.

In each of the above embodiments, it will be appreciated that the first abutment 34, 44 and elongate member 32, 42 may be passed through the material 50 either by pulling or pushing. To pull the security fastening 40 through material 50 a tool such as a needle means (not shown) may be used wherein the needle means receives the abutment 34, 44 and then is passed through the material 50 such that the needle means is then used to pull the first abutment 34, 44 through the material. Alternatively, a mechanism (not shown) to push the abutment 34, 44 through the material 50 may be used. Devices which push security fastenings such as security fastening 40 of FIG. 4 through material are known and may be used to insert security fastening 40.

Various modifications may be made to the embodiments hereinbefore described without departing from the scope of the invention. For example, the embodiments detailed above in FIGS. 7, 8, 10, 11 and 12 show material 50 being folded once prior to the tag 10 being secured to the material 50. However, it will be clearly understood that whilst the material 50 is shown as having been folded once prior to attachment of the tag 10, many folds may be applied to the material 50 such that the first abutment 34, 44 and the elongate member 32, 42 passes through the material 50 from the first surface 52 to the second surface 54 and back again more than once. Passing the elongate member 32, 42 through the material 50 a plurality of times will mean that in use only segments (not show) of the central portion 31, 41 of the elongate member 32, 42 will be exposed on the second surface 54 of the material 50 thus minimizing the likelihood of irritation occurring whilst still ensuring the tag 10 is firmly secured to the material 50.

In addition, whilst T-shaped abutments have been detailed in relation to security fastening 30, 40, it will be understood that any suitable retaining shape which enables to elongate member to be secured against the tag 10 may be used including, but not limited to V-shapes, conical shapes and curved shapes.

Whilst the ID tags have been detailed with reference to use on clothing and accessories such as shoes, it will be clearly understood that the ID tags may be attached to any desired material surface including, but not limited to, bag, hats and laces. The ID tags may be used to carry identifying data or may alternatively be used to display branding or advertisement data or personalized messages or images.

The material 50 has been detailed as having a first surface 52 which is substantially planar and lies substantially in parallel with second surface 54 which is also substantially planar and it will be understood that when used with clothing or accessories, the material will typically be a textile or fabric material of this form. However, the material may be any suitably thin and resilient material with even or uneven surfaces including but not limited to fabrics including textured, woven or knitted fabrics, leather material or the like, plastic materials or paper based materials.

Furthermore, removal of the tag 10 by releasing abutment 34, 44 from securing mechanism 20 has been detailed with reference to the above embodiments. However, tag 10 may be released by cutting or breaking elongate member 32, 42. This may be of particular use with tags 10 secured using security fastening 40 as the security fastening 40 may be disposed of after detaching and the tag 10 will remain intact and suitable for re-use.

The invention claimed is:

1. A method of attachment of a tag to a material having a first substantially planar surface and a second opposing planar surface, the method comprising the steps of:

a. providing a tag comprising a body, the tag having a first securing means and a flexible elongate member having a substantially T-shaped abutment at one end, the flexible elongate member provided distal to the first securing means and extending towards the first securing means, the flexible elongate member being adapted to pass through the fabric, the first securing means comprising a slot for receipt of at least a portion of the flexible elongate member therethrough, such that at least a portion of the flexible elongate member engages with the slot so as to remain under tension in relation to a flat side of the body and the T-shaped abutment cooperates with the slot to retain the flexible elongate member within the slot;

b. passing the flexible elongate member through the material from the first surface to the second surface and back again; and c. engaging the at least a portion of the flexible elongate member with the slot such that the elongate member remains under tension in relation to the flat side of the body and the T-shaped abutment cooperates with the slot to retain the flexible elongate member within the slot, thereby securing the fabric between the flat side of the body and the flexible elongate member.

2. The method as claimed in claim 1, wherein step b. further comprises passing the flexible elongate member through the material from the first surface to the second surface and back again a plurality of times.

3. The method as claimed in claim 1, wherein the method further comprises the step of folding the material.

* * * * *